US006244035B1

(12) United States Patent
Krill

(10) Patent No.: US 6,244,035 B1
(45) Date of Patent: Jun. 12, 2001

(54) GAS AND STEAM-TURBINE PLANT AND METHOD OF OPERATING THE PLANT

(75) Inventor: Martin Krill, Vienna (AT)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/550,210

(22) Filed: Apr. 17, 2000

Related U.S. Application Data

(63) Continuation of application No. PCT/DE98/02941, filed on Oct. 5, 1998.

(30) Foreign Application Priority Data

Oct. 15, 1997 (DE) ..... 197 45 272

(51) Int. Cl.[7] ..... F02C 6/18
(52) U.S. Cl. ..... 60/39.02; 60/39.182
(58) Field of Search ..... 60/39.02, 39.182; 122/7 R

(56) References Cited

U.S. PATENT DOCUMENTS 3,150,487 9/1964 Mangan et al. .
4,267,692 5/1981 Earnest .
5,457,951 * 10/1995 Johnson et al. ..... 60/39.182
5,678,401 * 10/1997 Kimura ..... 60/39.182

OTHER PUBLICATIONS

Published International Application No. WO 96/38656 (Johnson et al.), dated Dec. 5, 1996.

* cited by examiner

*Primary Examiner*—Louis J. Casaregola
(74) *Attorney, Agent, or Firm*—Herbert L. Lerner; Laurence A. Greenberg; Werner H. Stemer

(57) ABSTRACT

A gas and steam-turbine plant which constructed for an especially high plant efficiency includes a heat-recovery steam generator that is connected downstream of a gas turbine on the flue-gas side and has heating areas which are connected in a water/steam circuit of a steam turbine. A condenser connected downstream of the steam turbine on the steam side can be cooled by intake air to be fed to the gas turbine. A method of operating such a gas and steam-turbine plant is also provided.

7 Claims, 2 Drawing Sheets

GAS AND STEAM-TURBINE PLANT AND METHOD OF OPERATING THE PLANT

CROSS-REFERENCE TO RELATED APPLICATION

This application is a continuation of International Application No. PCT/DE98/02941, filed Oct. 5, 1998, which designated the United States.

BACKGROUND OF THE INVENTION

Field of the Invention

The invention relates to a gas and steam-turbine plant having a heat-recovery steam generator that is connected downstream of a gas turbine on the flue-gas side and has heating areas which are connected in a water/steam circuit of a steam turbine. The invention also relates to a method of operating such a gas and steam-turbine plant.

In a gas and steam-turbine plant, heat contained in an expanded working medium (flue gas) from the gas turbine is utilized to generate steam for the steam turbine. The heat transfer is effected in a heat-recovery steam generator, which is connected downstream of the gas turbine on the flue-gas side and in which heating areas are disposed in the form of tubes or banks of tubes. The latter in turn are connected in the water/steam circuit of the steam turbine. The water/steam circuit normally includes a plurality of pressure stages, for example two pressure stages. Each pressure stage has a preheating and an evaporator heating area.

The steam generated in the heat-recovery steam generator is fed to the steam turbine, where it expands to perform work. In this case, the steam turbine may include a number of pressure stages, which are adapted in their number and layout to the structure of the heat-recovery steam generator. The steam expanded in the steam turbine is normally fed to a condenser and condenses there. The condensate resulting during the condensation of the steam is fed again as feedwater to the heat-recovery steam generator, so that a closed water/steam circuit is obtained.

The condenser of such a gas and steam-turbine plant, like a heat exchanger, can normally be acted upon by a cooling medium, which extracts heat from the steam for the condensation. In that case, water is normally provided as the cooling medium. As an alternative, however, the condenser may also be constructed as an air condenser, to which air is admitted as the cooling medium.

SUMMARY OF THE INVENTION

It is accordingly an object of the invention to provide a gas and steam-turbine plant that has an especially high plant efficiency during various operating states and a method of operating such a gas and steam-turbine plant with which an especially high plant efficiency can be achieved, that overcome the hereinafore-mentioned disadvantages of the heretofore-known devices and methods of this general type.

With the foregoing and other objects in view there is provided, in accordance with the invention, a gas and steam-turbine plant, comprising a gas turbine receiving intake air and having a flue-gas side; a steam turbine having a water/steam circuit; a heat-recovery steam generator connected downstream of the gas turbine on the flue-gas side, the steam generator having heating areas connected in the water/steam circuit; a main condenser associated with the steam turbine; and a further condenser having a water/steam side connected in parallel with the main condenser, the further condenser to be cooled by the intake air.

The invention is based on the concept that, for an especially high plant efficiency, heat which develops in the plant process should be utilized to the greatest possible extent. At the same time, the heat extracted from the steam during its condensation should also be returned, at least partly, into the plant process. Due to the temperature level of the steam of about 60° C. during its condensation, the transfer of the heat extracted in the process into the intake air to be fed to the gas turbine is especially favorable.

The total mass flow of fuel/air mixture which can be fed overall to the gas turbine per unit of time is reduced by the preheating of the intake air of the gas turbine, so that the maximum power output attainable by the gas turbine is lower than if the preheating of the intake air were dispensed with. It has been found, however, that the fuel consumption drops to a greater extent than the maximum attainable power output during the preheating of the intake air by feeding of condensation heat, so that the overall efficiency increases.

In this case, the condenser, like an auxiliary condenser, may be acted upon by bleed steam from the steam turbine. In such a configuration, the condenser can be utilized in an especially favorable manner for providing a rapid power reserve which, for example, may also be required within a shorter reaction time to back up the line frequency of an electric network fed by the gas and steam-turbine plant. In this case, in order to activate the power reserve, the steam feed to the condenser is interrupted, so that the entire steam flow is directed through the main condenser. Therefore, a preheating of the intake air for the gas turbine does not occur, which leads to a rapid increase in the maximum output delivered by the gas turbine.

A compressor to which the intake air for the gas turbine can be fed through an intake-air line is normally assigned to the gas turbine. In accordance with another feature of the invention, the condenser is connected directly in the intake-air line on the cooling-medium side. In such a refinement, the condenser is expediently constructed as an air condenser. Losses as a result of conversion processes are kept especially low due to the single-stage heat transfer from the condensing steam to the intake air.

In accordance with a further feature of the invention, in an alternative development, the condenser is connected to a heat exchanger on the cooling-medium side through an intermediate cooling circuit, and the heat exchanger is in turn connected on the secondary side in the intake-air line connected upstream of the gas turbine. In such a configuration, the transport of the heat transferred during the condensation to a medium directed in the intermediate cooling circuit is also possible over large distances in a comparatively simple manner.

In accordance with an added feature of the invention, a steam-quantity ratio between the steam flows to be directed to the condenser and the main condenser is expediently adjustable, preferably as a function of the load state of the gas and steam-turbine plant. During operation of such a plant, the steam flow directed through the main condenser is condensed in a conventional manner with the use of an external cooling medium. At the same time, due to the adjustability of the steam-quantity ratio between the steam flows, the operating parameters of the steam flow directed through the condenser can be kept approximately constant in an especially simple manner, so that such a plant can be operated in an especially reliable manner. In addition, for every operating state of the plant, the intake air can thereby also be preheated to the maximum attainable temperature for the respective operating state.

In accordance with an additional feature of the invention, the main condenser has a condensate preheater connected downstream thereof, and condensate flowing off from the condenser, as viewed in the direction of flow of the condensate, can be fed downstream of the condensate preheater into the water/steam circuit of the steam turbine. Therefore, the residual heat remaining in the condensate after the condensation of the steam can be introduced into the water/steam circuit in an especially favorable manner.

With the objects of the invention in view, there is also provided a method of operating a gas and steam-turbine plant, which comprises preheating the intake air to be fed to the gas turbine with heat extracted during condensation from steam flowing off from the steam turbine.

In accordance with a concomitant mode of the invention, in the process, condensate obtained during the condensation is advantageously admixed to preheated condensate directed in the water/steam circuit of the steam turbine.

The advantages achieved with the invention reside in particular in the fact that, due to the transfer of the heat extracted during the condensation of the steam to the intake air for the gas turbine, this heat can be utilized for the plant process. Such a gas and steam-turbine plant therefore has an especially high plant efficiency. In this case, due to the fact that the maximum power output of the gas turbine is reduced comparatively slightly, a favorable efficiency of the gas and steam turbine can be achieved in particular in the partial-load range.

It has also emerged that such a gas and steam-turbine plant additionally exhibits comparatively lower pollutant emissions. In addition to other variables, a so-called changeover point, which indicates an output at which the gas turbine is to be changed over from diffusion operation to premix operation, is relevant to the pollutant emissions of a gas and steam-turbine plant. The gas and steam-turbine plant with preheated intake air for the gas turbine has a comparatively lower changeover point, so that it can also be run during comparatively low load states in premix operation, which is more favorable for low pollutant emissions.

Other features which are considered as characteristic for the invention are set forth in the appended claims.

Although the invention is illustrated and described herein as embodied in a gas and steam-turbine plant and a method of operating such a plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
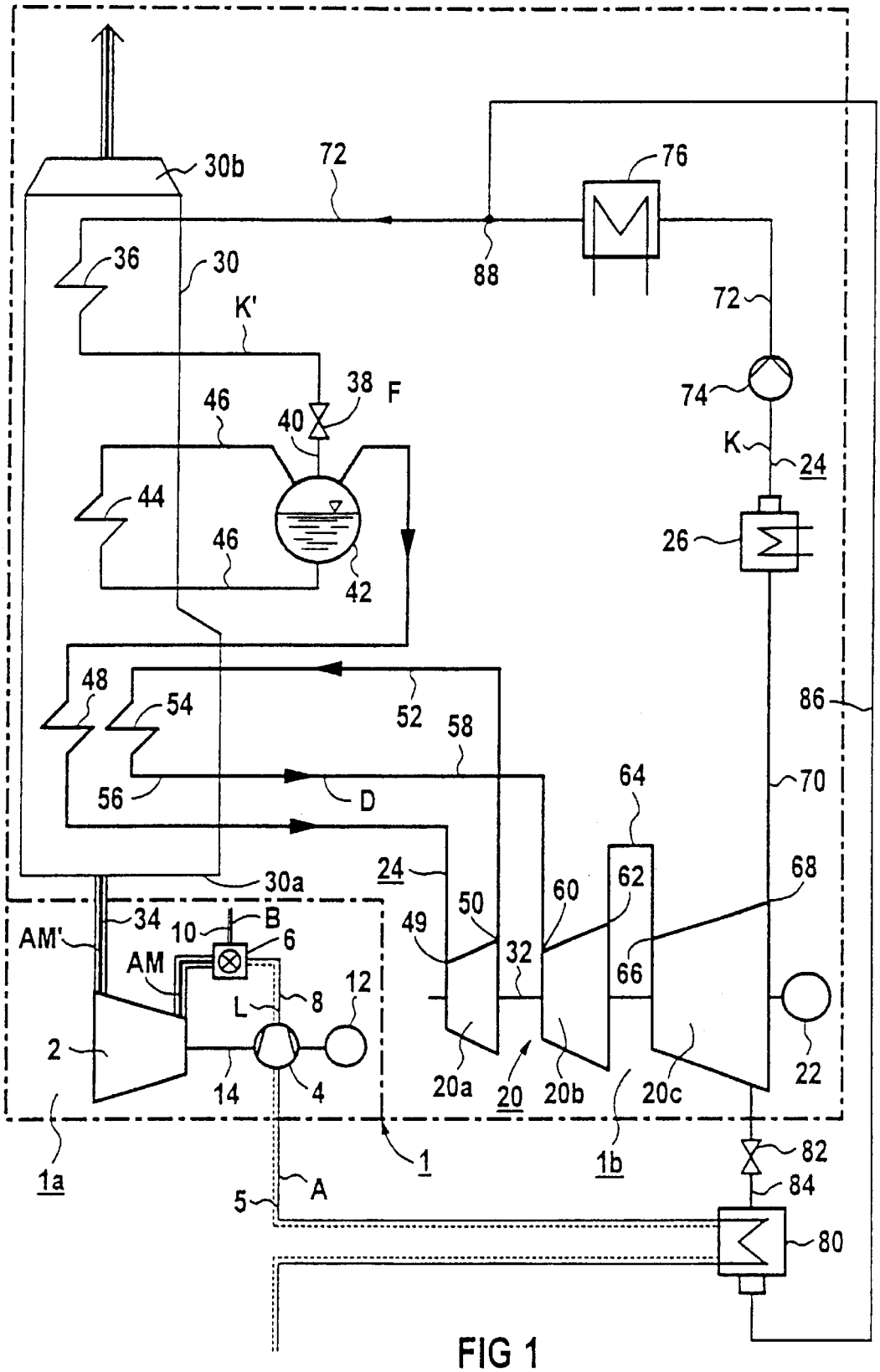
FIG. 1 is a schematic circuit diagram of a gas and steam-turbine plant.
Figure 2:
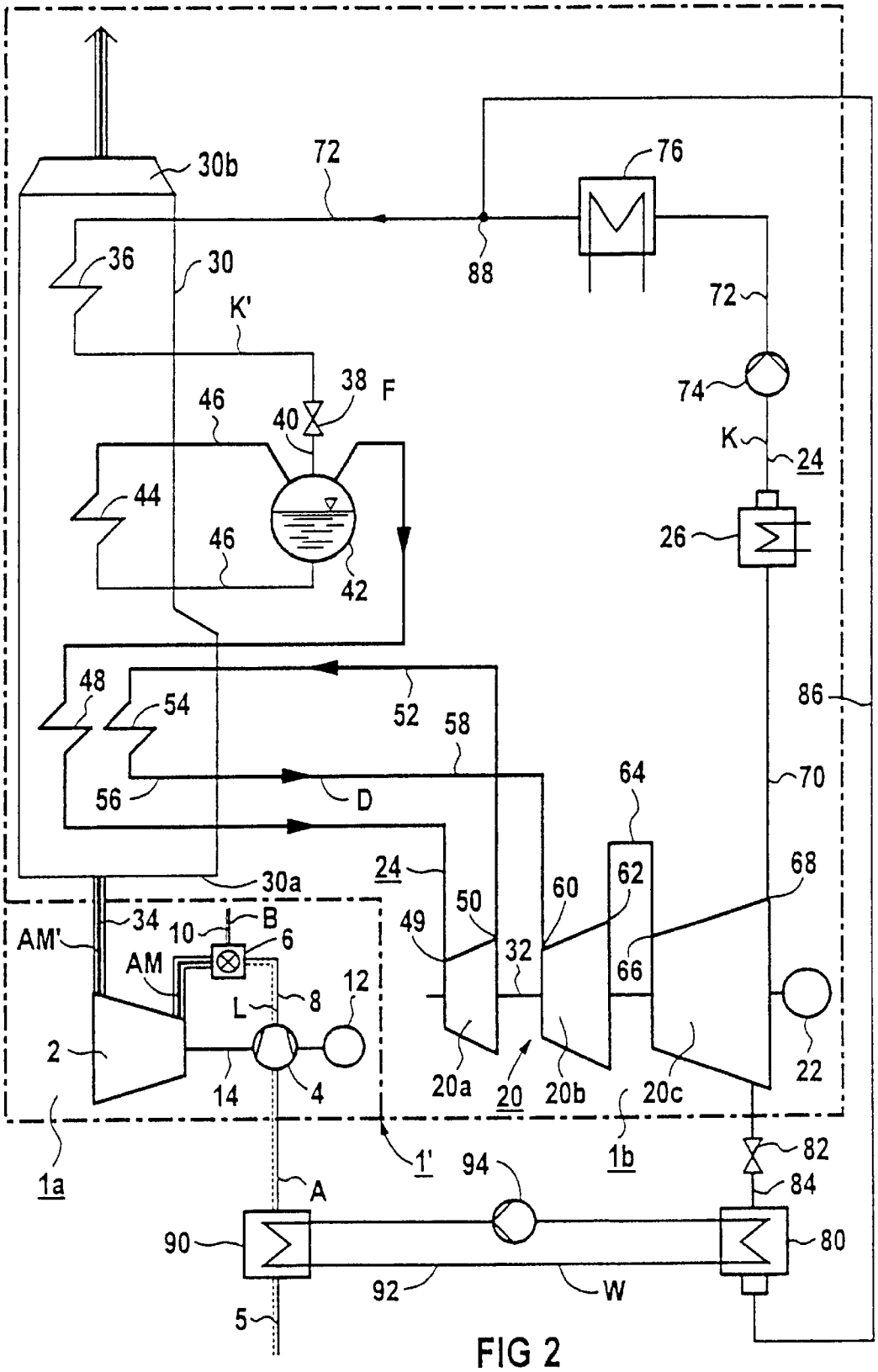
FIG. 2 is a schematic circuit diagram of an alternative embodiment of a gas and steam-turbine plant.

Referring now in detail to FIGS. 1 and 2 of the drawings as a whole, in which the same parts are provided with the same reference numerals, there is seen a respective, schematically illustrated gas and steam-turbine plant 1 and 1' including a gas-turbine plant la and a steam-turbine plant 1*b*. The gas-turbine plant 1*a* includes a gas turbine 2 with a coupled air compressor 4. The air compressor 4 is connected on the inlet side to an intake-air line 5. A combustion chamber 6, which is connected to a fresh-air line 8 of the air compressor 4, is disposed upstream of the gas turbine 2. A fuel line 10 leads into the combustion chamber 6 of the gas turbine 2. The gas turbine 2 and the air compressor 4 as well as a generator 12 sit on a common shaft 14.

The steam-turbine plant 1*b* includes a steam turbine 20 with a coupled generator 22, as well as a main condenser 26 disposed downstream of the steam turbine 20 and a heat-recovery steam generator 30, in a water/steam circuit 24. The steam turbine 20 is formed of a first pressure stage or high-pressure part 20*a,* a second pressure stage or intermediate-pressure part 20*b* as well as a third pressure stage or low-pressure part 20*c,* which drive the generator 22 through a common shaft 32.

In order to feed working medium AM' or flue gas expanded in the gas turbine 2 into the heat-recovery steam generator 30, an exhaust-gas line 34 is connected to an inlet 30*a* of the heat-recovery steam generator 30. The expanded working medium AM' from the gas turbine 2 leaves the heat-recovery steam generator 30 through an outlet 30*b* of the latter in the direction of a non-illustrated stack.

The water/steam circuit 24 has a first pressure stage or high-pressure stage, in which the heat-recovery steam generator 30 includes a high-pressure preheater or economizer 36 that is connected to a high-pressure drum 42 through a line 40 which can be shut off by a valve 38. The high-pressure drum 42 is connected to a high-pressure evaporator 44 disposed in the heat-recovery steam generator 30, for forming a water/steam circuit 46. In order to discharge live steam F, the high-pressure drum 42 is connected to a high-pressure superheater 48, which is disposed in the heat-recovery steam generator 30 and is connected on the outlet side to a steam inlet 49 of the high-pressure part 20*a* of the steam turbine 20.

A steam outlet 50 of the high-pressure part 20*a* of the steam turbine 20 is connected through a steam line 52 ("cold REHEAT") to a reheater 54. The reheater 54 has an outlet 56 which is connected through a steam line 58 to a steam inlet 60 of the intermediate-pressure part 20*b* of the steam turbine 20. A steam outlet 62 of the intermediate-pressure part 20*b* is connected through an overflow line 64 to a steam inlet 66 of the low-pressure part 20*c* of the steam turbine 20. A steam outlet 68 of the low-pressure part 20*c* of the steam turbine 20 is connected through a steam line 70 to the main condenser 26. The main condenser 26 is connected to the economizer 36 through a feedwater line 72, in which a feedwater pump 74 and a condensate preheater 76 are connected, so that the closed water/steam circuit 24 results.

Therefore, in the exemplary embodiments according to FIGS. 1 and 2, only the first pressure stage of the water/steam circuit 24 is shown in detail. However, further non-illustrated heating areas which are assigned in each case to an intermediate-pressure stage or a low-pressure stage of the water/steam circuit 24 are disposed in the heat-recovery steam generator 30. These heating areas are connected in a suitable manner to the steam inlet 60 of the intermediate-pressure part 20*b* of the steam turbine 20 or to the steam inlet 66 of the low-pressure part 20*c* of the steam turbine 20.

The gas and steam-turbine plant 1, 1' is constructed for achieving an especially high efficiency. To this end, a condenser 80 which is disposed downstream of the steam turbine 20 on the steam side and is constructed as an auxiliary condenser can be cooled through intake air A to be fed to the gas-turbine plant 1*a*. The condenser 80 is disposed downstream of the steam turbine 20 through a bleed-steam line 84, which can be shut off by a valve 82. An outlet side of the condenser 80 is connected through a condensate line 86 to the feedwater line 72, so that a water/steam side of the condenser 80 is connected in parallel with the main condenser 26 associated with the steam turbine 20. In this case, the condensate line 86 is connected to the feedwater line 72 at a feeding point 88. The feeding point 88, as viewed in the direction of flow of condensate K flowing off from the main condenser 26, is disposed downstream of the condensate preheater 76. A steam-quantity ratio between a partial steam flow directed to the main condenser 26 and a partial steam flow directed to the condenser 80 can be adjusted by the valve 82. The intake air A can be preheated up to a maximum attainable temperature by varying this steam-quantity ratio for each relevant power output of the gas and steam-turbine plant 1, 1'.

The gas and steam-turbine plant 1 according to FIG. 1 is constructed for a single-stage heat exchange between the partial steam flow to be condensed in the condenser 80 and the intake air A to be fed to the gas-turbine plant 1*a*. To this end, an air condenser, to which cooling air can be admitted as cooling medium, is provided as the condenser 80. In this case, the condenser 80 is connected directly in the intake-air line 5 on the cooling-medium side. In the case of the gas and steam-turbine plant 1, losses occurring as a result of conversion processes during the heat transfer from the steam condensing in the condenser 80 to the intake air A are kept especially low.

However, in the exemplary embodiment according to FIG. 2, a two-stage heat transfer from the steam to be condensed in the condenser 80 to the intake air A is provided. To this end, in the case of the gas and steam-turbine plant 1' according to FIG. 2, a separate heat exchanger 90 is connected in the intake-air line 5. The separate heat exchanger 90 is connected on the primary side to an intermediate circuit 92, to which the condenser 80 is connected on the cooling-medium side. In this case, heat-transfer medium W directed in the intermediate circuit 92 can be circulated through the use of a circulation pump 94 connected in the intermediate circuit 92.

During operation of the gas and steam-turbine plant 1 or of the gas and steam-turbine plant 1', a partial steam flow extracted from the low-pressure part 20*c* of the steam turbine 20 is directed as bleed steam through the condenser 80. This partial steam flow is condensed in the condenser 80, and the heat extracted from the steam during its condensation is transferred to the intake air A for the gas-turbine plant 1*a*. The condensate obtained during the condensation of the steam in the condenser 80 is admixed to the preheated condensate K flowing off from the main condenser 26.

Due to the transfer of the heat extracted from the partial steam flow during its condensation in the condenser 80 to the intake air A for the gas-turbine plant 1*a*, this heat is returned into the energy-conversion process of the respective gas and steam-turbine plant 1 or 1'. On one hand, the gas and steam-turbine plant 1, 1' therefore has an especially high plant efficiency. On the other hand, however, the preheating of the intake air A for the gas-turbine plant 1*a* also results in the total mass flow of the working medium AM which can be fed to the gas turbine 2 being smaller than if the preheating of the intake air A were dispensed with. The maximum power output attainable during operation of the gas turbine 2 is therefore comparatively smaller. The operation of the gas and steam-turbine plant 1, 1' with preheating of the intake air A by condensation of bleed steam in the condenser 80 is therefore especially suitable for the partial-load range. In addition, in this mode of operation, a rapid power reserve of the gas and steam-turbine plant 1, 1' is ensured in an especially simple form. This is because, if the preheating of the intake air A is rapidly shut off, a rapid increase in the power output of the gas turbine 2 is made possible due to the then comparatively increased available total mass flow of working medium AM for the gas turbine 2.

I claim:

1. A gas and steam-turbine plant, comprising:

a gas turbine receiving intake air and having a flue-gas side;

a steam turbine having a water/steam circuit;

a heat-recovery steam generator connected downstream of said gas turbine on said flue-gas side, said steam generator having heating areas connected in said water/steam circuit;

a main condenser associated with said steam turbine; and a further condenser having a water/steam side connected in parallel with said main condenser, said further condenser to be cooled by the intake air.

2. The gas and steam-turbine plant according to claim 1, wherein said further condenser has a cooling-medium side, a compressor is associated with said gas turbine, and an intake-air line is directly connected to said further condenser on said cooling-medium side and is connected upstream of said compressor.

3. The gas and steam-turbine plant according to claim 1, wherein said further condenser has a cooling-medium side, a compressor is associated with said gas turbine, an intake-air line is connected upstream of said compressor, a heat exchanger has a secondary side connected to said intake-air line, and an intermediate cooling circuit is connected to said cooling-medium side of said further condenser and said heat exchanger.

4. The gas and steam-turbine plant according to claim 1, wherein a steam-quantity ratio of steam flows to be directed to said further condenser and said main condenser is adjustable.

5. The gas and steam-turbine plant according to claim 1, including a condensate preheater connected downstream of said main condenser, and wherein condensate flowing off from said further condenser is fed in a condensate flow direction into said water/steam circuit downstream of said condensate preheater.

6. A method of operating a gas and steam-turbine plant, which comprises:

providing a gas turbine receiving intake air and having a flue-gas side;

providing a steam turbine having a water/steam circuit;

providing a heat-recovery steam generator downstream of the gas turbine on the flue-gas side, the steam generator having heating areas connected in the water/steam circuit;

providing a main condenser associated with the steam turbine;

providing a further condenser to be cooled by the intake air, the further condenser having a water/steam side connected in parallel with the main condenser; and preheating the intake air to be fed to the gas turbine with heat extracted during condensation from steam flowing off from the steam turbine.

7. The method according to claim 6, which further comprises admixing the condensate obtained during the condensation with preheated condensate directed in the water/steam circuit of the steam turbine.

* * * * *